US005934861A

United States Patent [19]

McLeod

[11] Patent Number: 5,934,861

[45] Date of Patent: Aug. 10, 1999

[54] COLLECTION OF LUMBER PIECES FROM SPACED STACKS

[76] Inventor: James A. McLeod, Box 34, Vassar, Manitoba, Canada, R0A 2J0

[21] Appl. No.: 08/917,687

[22] Filed: Aug. 26, 1997

[51] Int. Cl.[6] ..... B60P 1/04

[52] U.S. Cl. ..... 414/502; 198/510.1; 414/505

[58] Field of Search ..... 414/434, 437, 414/442, 489, 493, 502, 503, 504, 505; 198/416, 510.1, 512, 518, 598

[56] References Cited

U.S. PATENT DOCUMENTS

| | | | |
|---|---|---|---|
| 2,267,303 | 12/1941 | Jordan | 198/518 X |
| 3,508,672 | 4/1970 | Stanoy et al. | 198/416 X |
| 3,802,022 | 4/1974 | Fleming | 414/505 X |
| 4,290,820 | 9/1981 | Swisher, Jr. et al. | 198/518 X |
| 4,295,560 | 10/1981 | Cross | 198/598 X |
| 4,478,152 | 10/1984 | Holley | 414/437 X |
| 4,930,615 | 6/1990 | Nash | 198/416 X |
| 5,596,784 | 1/1997 | Tolmachoff | 414/502 X |
| 5,745,947 | 5/1998 | Liu et al. | 414/502 X |

FOREIGN PATENT DOCUMENTS

| | | | |
|---|---|---|---|
| 1172190 | 6/1964 | Germany | 198/510.1 |
| 2159491 | 12/1985 | United Kingdom | 414/502 |

*Primary Examiner*—James W. Keenan

*Attorney, Agent, or Firm*—Adrian D. Battison; Murray E. Thrift

[57] ABSTRACT

An apparatus for picking and conveying lumber pieces from the ground for example for removing stacked support lumber during laying of a pipe line comprises a tracked vehicle carrying a transport conveyer across the rear of the vehicle and a conveyer table extending from the feed end of the main conveyer forwardly and downwardly toward the ground. At the forward picking end is provided a picker roller for lifting the lumber pieces from the ground. On one side of the picker roller is provided a drive conveyer which is generally vertical and driven at a high speed so that ends of the lumber pieces engaging the drive conveyer are driven rapidly rearwardly over the picker roller onto the conveyer so as to move along their length. On the side opposite to the drive conveyers provided a vertical flap which can pivot from side to side to push the lumber pieces toward the drive conveyer. The forward end of the conveyer table can be moved vertically and horizontally so as to engage the stack at the required position.

6 Claims, 3 Drawing Sheets

SECTION X-X

COLLECTION OF LUMBER PIECES FROM SPACED STACKS

FIELD OF THE INVENTION

This invention relates to an apparatus for collecting lumber pieces from spaced stacks of the lumber pieces.

BACKGROUND

In laying pipe such as in a gas or oil pipe line it is conventional that lengths of the pipe are supported end to end on stack lumber pieces known as "skids" so that the pipe lengths can be held at a required height to be supported and aligned end to end for welding of the lengths prior to feeding of the completed welded length into a trench adjacent to the stacks.

Thus the pipe lengths are initially arranged end to end and are properly aligned by arranging sufficient of the lumber pieces to support the pipe length at the required height. With the pipe lengths so supported, the welding is carried out to form the lengths into a continuous length for laying in the ground.

The continuous length is then lifted from the supporting stacks and deposited into the ground by a train of tracked vehicles carrying suitable operation element so that the lifted continuous pipe length can be feed from the supported position into the trench. After the pipe has been laid, it is necessary to collect the lumber pieces from the stacks and to discharge the collected lumber pieces into a transport container for removal from the sight and preferable for use at a further location along the pipeline.

A the present time the lumber pieces which are conventionally five feet in length and 6 inches by 4 inches in cross section are lifted manually and handled manually for stacking onto a transport container. This manual process is expensive and time consuming since it requires a gang of laborers working vigorously at high wage rates. In many cases that stack has been disturb so that the pieces are strewn and in some cases the pieces are compresses into the ground by the tracks of the passing vehicles.

While this step relatively minor one in the process of laying the pipe line, it constitutes a significant expense and therefore provides a significant opportunity for manufacturer of an effective machine which will carry out this step while eliminating or reducing the manual labor involved.

SUMMARY

It is one object of the present invention therefore to provide an improved machine for collecting lumber pieces which can be used in for example in collecting the stacks or skids for supporting pipe lengths prior to laying of the pipe.

According to one aspect of the invention there is provided anApparatus for collecting lumber pieces comprising;

a vehicle for moving a working direction across the ground between stacks on the ground of the lumber to be collected;

a transport conveyer mounted on the vehicle for conveying the lumber pieces from the stack on the ground to a transport container;

and a picking assembly for lifting the lumber pieces from the ground on to the conveyer, the picking assembly comprising;

a conveyer table having a conveyer section thereon for transporting the lumber pieces from a forward feed end of the conveyer table adjacent the ground to a rear discharge end of the conveyer section;

means mounting the conveyer table for movement of the forward end vertically up and down for adjustment of a height of the forward end;

means mounting the conveyer table for movement of the forward end horizontally side to side for adjustment of a distance of the forward end relative to the vehicle;

a toothed picker roller at the forward end in front of the conveyer section and rotatable about a horizontal axis at right angles to the working direction;

and a feed conveyer on one side of the forward end at one end of the picker role for moving lumber pieces contacting the feed conveyer rearwardly toward the conveyer section.

Preferably the feed conveyer is driven at a rate faster than that of the picker roller and the conveyer section so as to move an end of a lumber piece engaging the feed conveyer rearwardly to turn the lumber piece to present said end forwardly of the lumber in a direction of movement of the lumber piece.

Preferably the feed conveyer defines a substantially vertical surface.

Preferably the feed conveyer comprises an endless belt having a pair of vertical drive rollers.

Preferably the feed conveyer extends along a part only of the table.

Preferably there is provided a pusher member at an end of the picker roller opposite to the drive conveyer for pushing the lumber pieces toward the drive conveyer.

Preferably the pusher member is pivotally mounted on the conveyer table for pivotable movement about a vertical axis.

Preferably the pusher member comprises a flap standing a substantially vertical plane.

BRIEF DESCRIPTION OF THE DRAWINGS

In the accompanying drawings, which illustrate an exemplary embodiment of the present invention.

DETAILED DESCRIPTION

Figure 1:
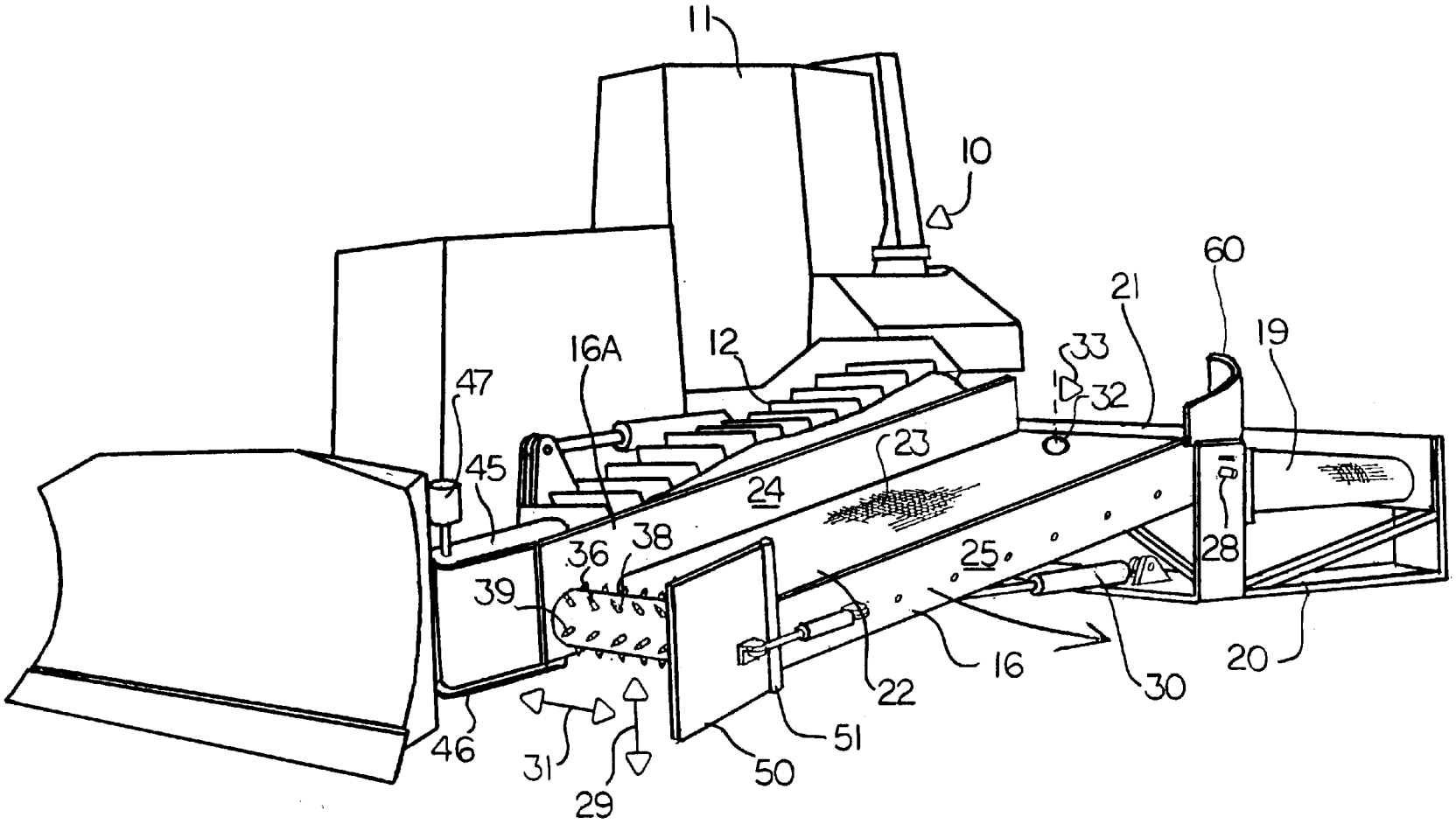
FIG. 1 is a perspective view of an apparatus according to the present invention.
Figure 2:
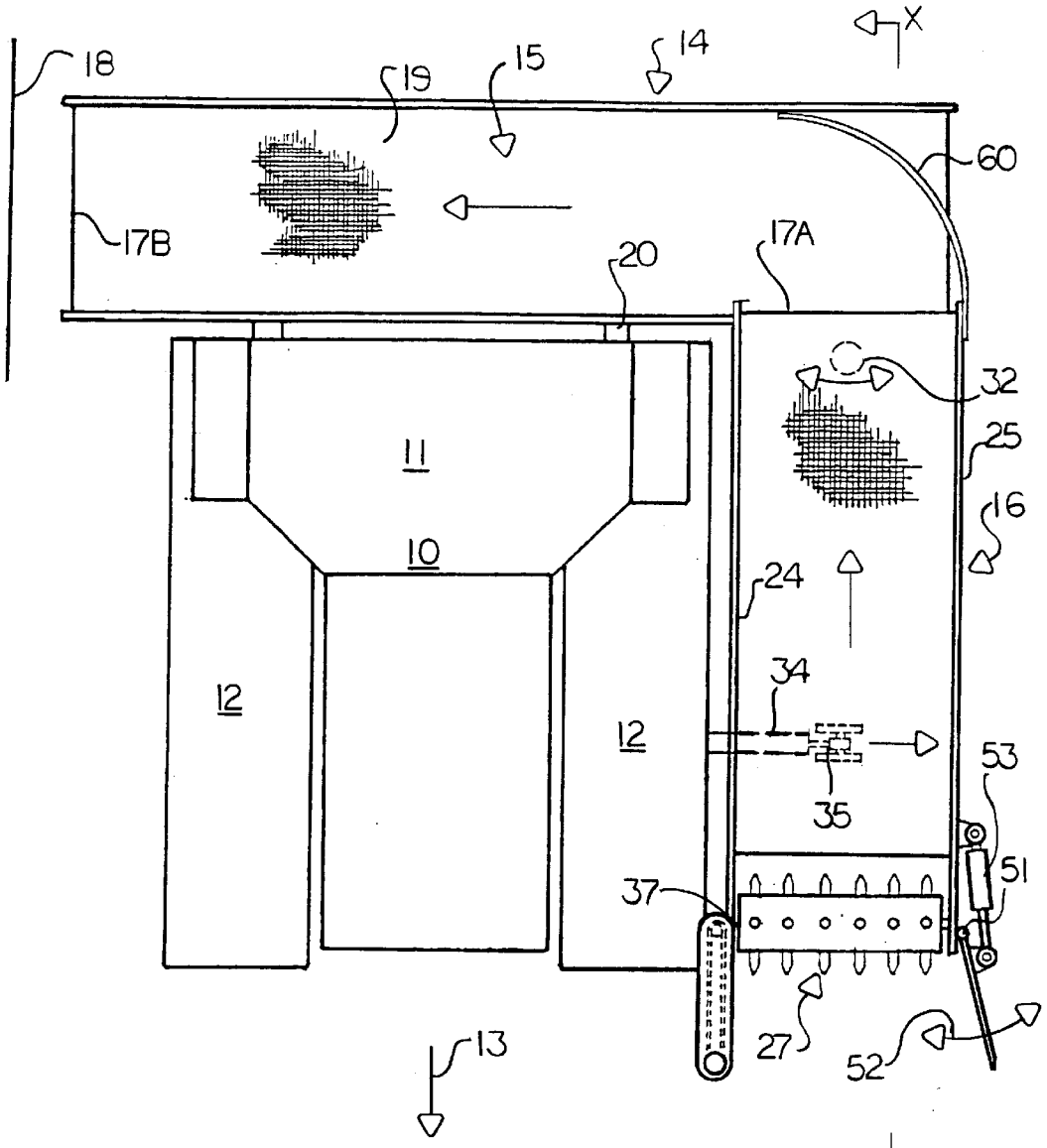
FIG. 2 is a top plan view of the apparatus of FIG. 1.
Figure 3:
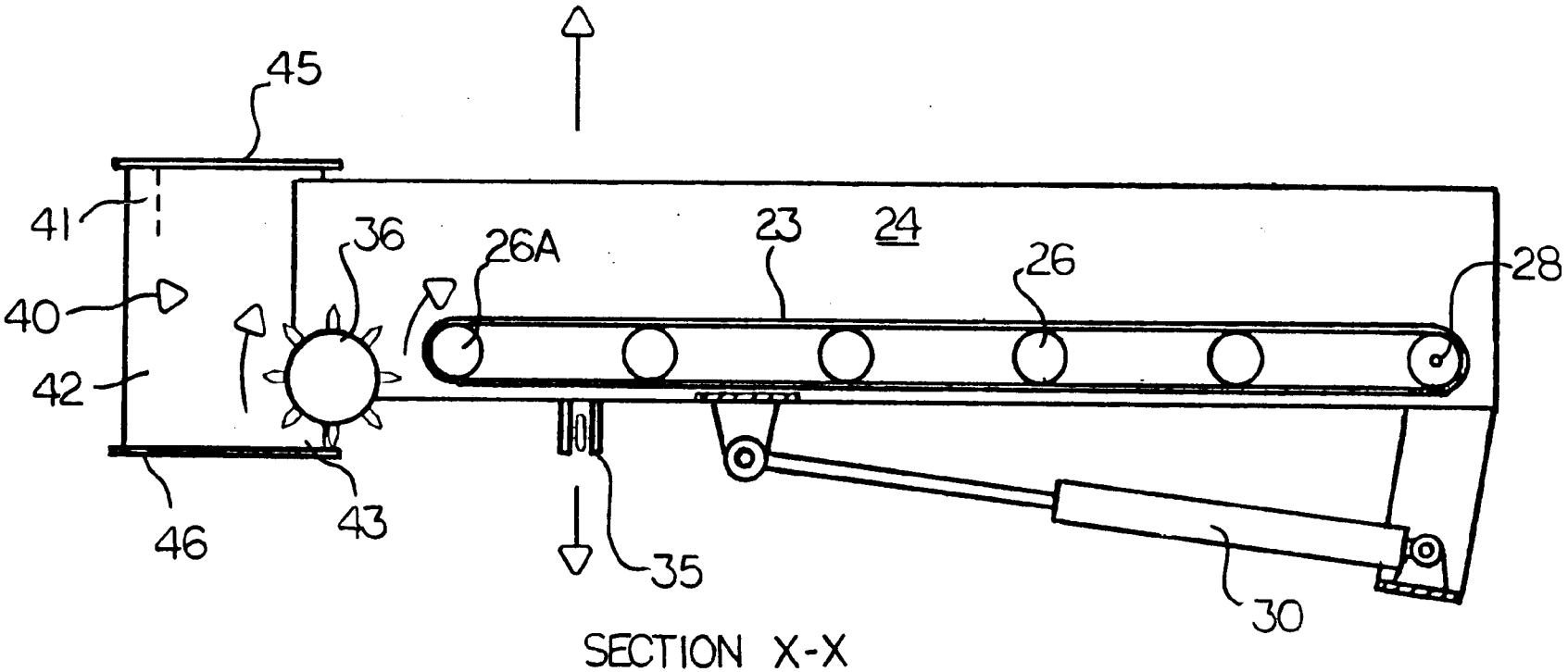
FIG. 3 is side elevational view of the apparatus of FIG. 1.

The apparatus comprises a conventional tracked vehicle 10 having a cab 11 and a tracks 12 by which the vehicle can move across the ground in a direction 13 of working movement. The vehicle carries a picking and conveying system generally indicated at 14 including a main conveyer 15 and a conveyer table 16 feeding the main conveyer 15.

The main conveyer is mounted behind the cab 11 of the vehicle from the feed end 16*a* of the conveyer to a discharge end 17 of the conveyer, the later feeding toward a transportation container shown schematically at 18. The main conveyer 15 comprises a conveyer belt 19 carried on a frame 20 having a rear guide wall 21 for directing the lumber pieces along the conveyer carried by the belt 19.

The conveyer table includes a conveyer section 22 having a belt 23 similar to the belt 19 and mounted between side plates 24 and 25 on suitable drive rollers 26.

The conveyer table is inclined downwardly and forwardly from the feed end 17*a* of the main conveyer along one track 12 to a forward picking end 27 of the conveyer table adjacent the front of vehicle 10.

The conveyer table 16 is mounted for pivotal movement about a horizontal pivot shaft 28 defining a pivot access adjacent the feed end 17*a* for upward and downward vertical movement 29 of the forward end 27 of the conveyer table. Actuation of the vertical movement 29 is effected by a hydraulic drive cylinder 30 connected between the frame 20 and the underside of the conveyer table 16.

The conveyer table is also mounted for horizontal side to side movement 31. For this purpose the shaft 28 is mounted on a suitable swivel mount 32 which allows the shaft to pivot about a vertical access 33 and thus allow the conveyer table to move so that its forward end moves side to side towards and away from the track 12. Actuation of the movement is effected by a cylinder 34 connected between the side frame of the track 12 and a bracket 35 on the underside of the conveyer table 16.

On the side wall 24 and 25 in front of the front roller 26*a* of the conveyer belt 23 is provided a picker roller 36. The picker roller 36 is mounted on a shaft 37 carried in suitable bearings on the side plates 24 and 25 and the picker roller is driven by a motor which rotates the picker roller in a clock wise direction tending to lift material from the ground on to the upper run of the belt 23. The picker roller 36 comprises a rigid cylindrical wall 38 on which is mounted a plurality of rows of spikes 39 at angularly spaced positions around the picker roll. Thus the spikes engage materials on the ground or can be driven into the ground by adjusting the height of the table downwardly to engage the ground thus tending to lift the lumber pieces from the ground or from a position imbedded in the ground. The spikes thus project below the bottom edges of the side plates 24 and 25.

The spikes are sufficiently sharp that they tend to engage into the lumber in a picking action thus tending to lift the lumber pieces from the ground. The forward roller 26*a* of the conveyer belt is located immediately behind the picker roll so as to strip the lumber pieces from the picker role so that they are passed over the top of the picker role and to feed the lumber pieces onto the belt 23 for transportation to the conveyer 15.

Attached to the side plate 24 is a drive conveyer 40 having a belt 41 supported on vertical rollers 42 and 43. The rollers are carried on a horizontal top support plate 45 and a horizontal bottom plate 46 and are driven by a motor 47. The inside run of the belt facing toward the picker roller is located in front of the picker roller and is driven a speed so that any lumber pieces having an end engaging the drive conveyer are driven rapidly rearwardly at a rate faster than the feeder rate of the picker roller and the belt 23 so that the end engaging the drive conveyer is driven rearwardly tending to align the lumber pieces along the length of the conveyer belt 23.

On the opposite side to the drive conveyer is provided a pusher member 50 in the form of a vertical flap or plate mounted for pivotal movement about a vertical pivot access at the front of the side plate 25. Thus a hinge structure 51 is mounted on the side plate 25 adjacent its forward end with the flap 50 attach to the hinge structure 51 allowing the plate to move inwardly and outwardly as indicated at 52. Actuation of the movement is effected by a cylinder 53 connected between outside surface of the side plate 25 and the outside surface of the flap 50.

The operator thus can move the vehicle 10 along the direction of movement 13 while adjusting the height and horizontal position of the forward end of the conveyer table so as to reach out to engage and grasp the lumber pieces in the stack to one side of the vehicle. The flap 50 can then be operated to push the lumber pieces toward the drive conveyer 40 so that the end of the lumber pieces adjacent the side plate 24 are moved rapidly rearwardly onto the conveyer belt over the picker roller. The flap 50 can be actuated a number of time to push lumber pieces toward the drive conveyer and to ensure that all lumber pieces are properly moved from a resting or embedded position on or in the ground onto the picker roller or onto the drive conveyer for lifting from the ground onto the conveyer belt 23.

At the upper rear end of the conveyer table is provided a guide wall 60 which provides a curved inside surface tending to turn the lumber pieces from their movement lying longitudinal along the conveyer belt 23 so that the lumber pieces move through a right angle and continue to move along their length as they along the conveyer belt 19. Some of the pieces are thus feed length wise through the conveyer system to the transport container 18.

While one embodiment of the present invention has been described in the foregoing, it is to be understood that other embodiments are possible within the scope of the invention. The invention is to be considered limited solely by the scope of the appended claims.

I claim:

1. Apparatus for collecting elongate lumber pieces comprising;

a vehicle for moving in a working direction across the ground between stacks on the ground of the lumber to be collected;

a transport conveyer mounted on the vehicle for conveying the lumber pieces from the stack on the ground to a transport container;

and a picking assembly for lifting the lumber pieces from the ground onto the conveyer, the picking assembly comprising;

a conveyer table having a conveyer section thereon for transporting the lumber pieces from a forward feed end of the conveyor table adjacent the ground to a rear discharge end of the conveyer section;

means mounting the conveyer table for movement of the forward end vertically up and down for adjustment of a height of the forward end;

means mounting the conveyer table for movement of the forward end horizontally side to side for adjustment of a distance of the forward end relative to the vehicle;

a toothed picker roller at the forward end in front of the conveyer section and rotatable about a horizontal axis at a right angle to the working direction;

and a feed conveyer on one side of the forward end at one end of the picker roller for moving lumber pieces contacting the feed conveyer rearwardly toward the conveyer section, the feed conveyer being driven at a rate faster than that of the picker roller and the conveyer section so as to tend to turn an end of an elongate lumber piece engaging the feed conveyer rearwardly such that the lumber piece tends to lie longitudinally along the conveyer section when transported thereal-ong.

2. The apparatus according claim 1 wherein the feed conveyer defines a substantially vertical conveyer surface.

3. The apparatus according to claim 2 wherein the conveyer surface of the feed conveyer is defined by one run of an endless belt carried on a pair of vertical drive rollers.

4. The apparatus according claim 1 wherein the feed conveyer extends along a forward part only of the conveyer table.

5. The apparatus according to claim 1 wherein there is provided a single feed conveyer at one end only of the picker roller and wherein there is provided a single pusher plate at the other end only of the picker roller opposite to the feed conveyer for pushing the lumber pieces toward the feed conveyer, the pusher plate being pivotally mounted on the conveyer table for pivotal movement about a generally vertical axis such that a forward end of the pusher plate moves generally horizontally toward the feed conveyer for co-operation therewith to tend to turn an end of an elongate lumber piece engaging the feed conveyer rearwardly onto the conveyer section.

6. Apparatus for collecting elongate lumber pieces comprising;

a vehicle for moving in a working direction across the ground between stacks on the ground of the lumber to be collected;

a transport conveyer mounted on the vehicle for conveying the lumber pieces from the stack on the ground to a transport container;

and a picking assembly for lifting the lumber pieces from the ground onto the conveyer, the picking assembly comprising;

a conveyer table having a conveyer section thereon for transporting the lumber pieces from a forward feed end of the conveyor table adjacent the ground to a rear discharge end of the conveyer section;

means mounting the conveyer table for movement of the forward end vertically up and down for adjustment of a height of the forward end;

means mounting the conveyer table for movement of the forward end horizontally side to side for adjustment of a distance of the forward end relative to the vehicle;

a single feed conveyer on one side only of the forward end at one end of the picker roller for moving lumber pieces contacting the feed conveyer rearwardly toward the conveyer section;

the feed conveyer having a conveyer surface defined by one run of an endless belt carried on a pair of vertical drive rollers;

and a single pusher plate on the other side only of the forward end opposite to the feed conveyer for pushing the lumber pieces toward the single feed conveyer, the pusher plate being pivotally mounted on the conveyer table for pivotal movement about a generally vertical axis such that a forward end of the pusher member moves generally horizontally toward the feed conveyer for co-operation therewith to tend to turn an end of an elongate lumber piece engaging the feed conveyer rearwardly onto the conveyer section.

* * * * *